US008522950B2

(12) United States Patent
Martin

(10) Patent No.: US 8,522,950 B2
(45) Date of Patent: Sep. 3, 2013

(54) DEBRIS DIVERTER FOR COIN COUNTING MACHINE AND ASSOCIATED METHOD OF MANUFACTURE AND OPERATION

(75) Inventor: Douglas A. Martin, Woodinville, WA (US)

(73) Assignee: Outerwall Inc., Bellevue, WA (US)

( * ) Notice: Subject to any disclaimer, the term of this patent is extended or adjusted under 35 U.S.C. 154(b) by 0 days.

(21) Appl. No.: 13/228,676

(22) Filed: Sep. 9, 2011

(65) Prior Publication Data

US 2013/0065497 A1 Mar. 14, 2013

(51) Int. Cl.
*G07F 1/04* (2006.01)

(52) U.S. Cl.
USPC ..... 194/347

(58) Field of Classification Search
USPC ..... 194/347–349, 344; 198/670; 453/12, 453/15, 49, 57; 209/658, 662; 221/116
See application file for complete search history.

(56) References Cited

U.S. PATENT DOCUMENTS

| | | | | | |
|---|---|---|---|---|---|
| 2,336,606 | A | * | 12/1943 | Everett | 198/390 |
| 2,964,181 | A | * | 12/1960 | Demarest et al. | 209/654 |
| 3,381,694 | A | * | 5/1968 | Lempke | 453/57 |
| 4,059,122 | A | | 11/1977 | Kinoshita | |
| 4,266,651 | A | * | 5/1981 | Strom | 198/345.1 |
| 4,416,334 | A | * | 11/1983 | Bouillon | 171/27 |
| 4,995,848 | A | * | 2/1991 | Goh | 453/3 |
| 5,282,769 | A | | 2/1994 | Suzukawa | |
| 5,355,988 | A | * | 10/1994 | Shirasawa | 194/217 |
| 5,356,333 | A | * | 10/1994 | Bointon et al. | 453/40 |
| 5,620,079 | A | | 4/1997 | Molbak | |
| 5,910,044 | A | * | 6/1999 | Luciano et al. | 453/32 |
| 5,929,366 | A | * | 7/1999 | Kennedy | 89/33.17 |
| 6,042,471 | A | * | 3/2000 | Tanaka | 453/56 |
| 6,059,650 | A | * | 5/2000 | Stoltz et al. | 453/40 |
| 6,095,916 | A | * | 8/2000 | Tamaki | 453/57 |
| 6,253,809 | B1 | * | 7/2001 | Paradies | 141/372 |
| 6,725,630 | B2 | * | 4/2004 | Rea et al. | 53/478 |
| 6,766,892 | B2 | * | 7/2004 | Martin et al. | 194/317 |
| 6,863,168 | B1 | | 3/2005 | Gerrity et al. | |
| 7,520,374 | B2 | | 4/2009 | Martin et al. | |
| 7,658,668 | B2 | | 2/2010 | Hill | |
| 2003/0092365 | A1 | * | 5/2003 | Grube | 451/178 |
| 2009/0159395 | A1 | * | 6/2009 | Gerrity et al. | 194/347 |
| 2010/0330892 | A1 | * | 12/2010 | Nishida | 453/56 |
| 2011/0259709 | A1 | * | 10/2011 | Grossmann | 198/339.1 |

FOREIGN PATENT DOCUMENTS

| | | |
|---|---|---|
| JP | 07306976 | 11/1995 |

OTHER PUBLICATIONS

International Search Report and Written Opinion, PCT Application No. PCT/US2012/049011, Mail Date Jan. 29, 2013, 8 pages.

* cited by examiner

*Primary Examiner* — Jeffrey Shapiro
(74) *Attorney, Agent, or Firm* — Perkins Coie LLP

(57) ABSTRACT

Apparatuses, systems, and methods for separating debris from coins and the like from customer-operated kiosks and other machines. A debris diverter including a motor, a rotating bobbin, and at least one vane is positioned over a coin track with the vane spaced apart from the coin track by a predetermined distance to permit objects smaller than the predetermined distance to pass by the debris diverter and to contact objects larger than the predetermined distance.

24 Claims, 4 Drawing Sheets

DEBRIS DIVERTER FOR COIN COUNTING MACHINE AND ASSOCIATED METHOD OF MANUFACTURE AND OPERATION

TECHNICAL FIELD

The following disclosure relates generally to systems, apparatuses and methods for preventing debris from entering a coin counting machine.

BACKGROUND

A variety of machines that sort coins have been patented. One such machine, shown in U.S. Pat. No. 4,995,848 to David Goh, uses two methods to sort coins, both methods based on the diameter of the coins. In this machine the coins are loaded into a hopper. A rotating wheel feeds the coins individually onto an inclined ramp. The coins roll down the ramp with their rear surfaces resting against a support surface. Specific denominations are selected when they fall through slots of varying size located in the support surface. Specific denominations are also selected using peeler knives that are arranged at different distances from the ramp surface. These knives topple the coins from the ramp into bins. Using both techniques allows a short ramp to be employed. Another type of machine, shown in U.S. Pat. No. 4,059,122 to Yoshio Kinoshita, counts the number of coins according to denomination after sorting the coins.

A number of counting and sorting devices are deficient for various reasons. Many devices, while having some form of waste control device, have been unsuccessful in completely controlling waste that may be mixed in with the coins. As a result, many previous devices are only suitable for operation by an experienced or skilled operator and are not suitable for use by members of the general public, who may be less careful about including foreign or waste material among the coins. In particular, many previous devices were designed to admit coins into the counting device at such a rate that it was not possible for each coin to be individually exposed to the waste control device, i.e., such that some coins may block others from the waste control system.

Some counting/sorting devices have a complicated or ineffective mechanism to control the flow of coins so that it is difficult or expensive to prevent unacceptably high surges of coin flow from jamming or otherwise overwhelming the sorting/counting mechanism. Some devices were designed to permit only a slow entry of coins into the counting/sorting mechanism, but in some cases, this was done at the expense of the ability to accommodate a high volume of coins and/or resulted in unacceptably slow operation.

Accordingly, it would be advantageous to provide a device that receives an arbitrary number of coins, i.e., that does not require insertion of an exact minimum amount, and that converts the value of the coins from the inconvenient medium of coins to a more convenient medium. It would be further advantageous to provide a device that provides for effective and efficient waste management such that the device can be used by the ordinary consumer without jamming or damaging the machine. It would also be advantageous to provide for a device which accommodates a high volume or flow of coins without permitting surges of coin flow that can interfere with the counting/sorting and/or waste management systems, that does not have complicated electro/mechanical machinery and, preferably, that takes advantage of a gravity mechanism. It would also be useful to provide a device that efficiently and conveniently delivers the sorted coins in a standard sized coin bag that is conveniently accessible.

DETAILED DESCRIPTION

Figure 1:
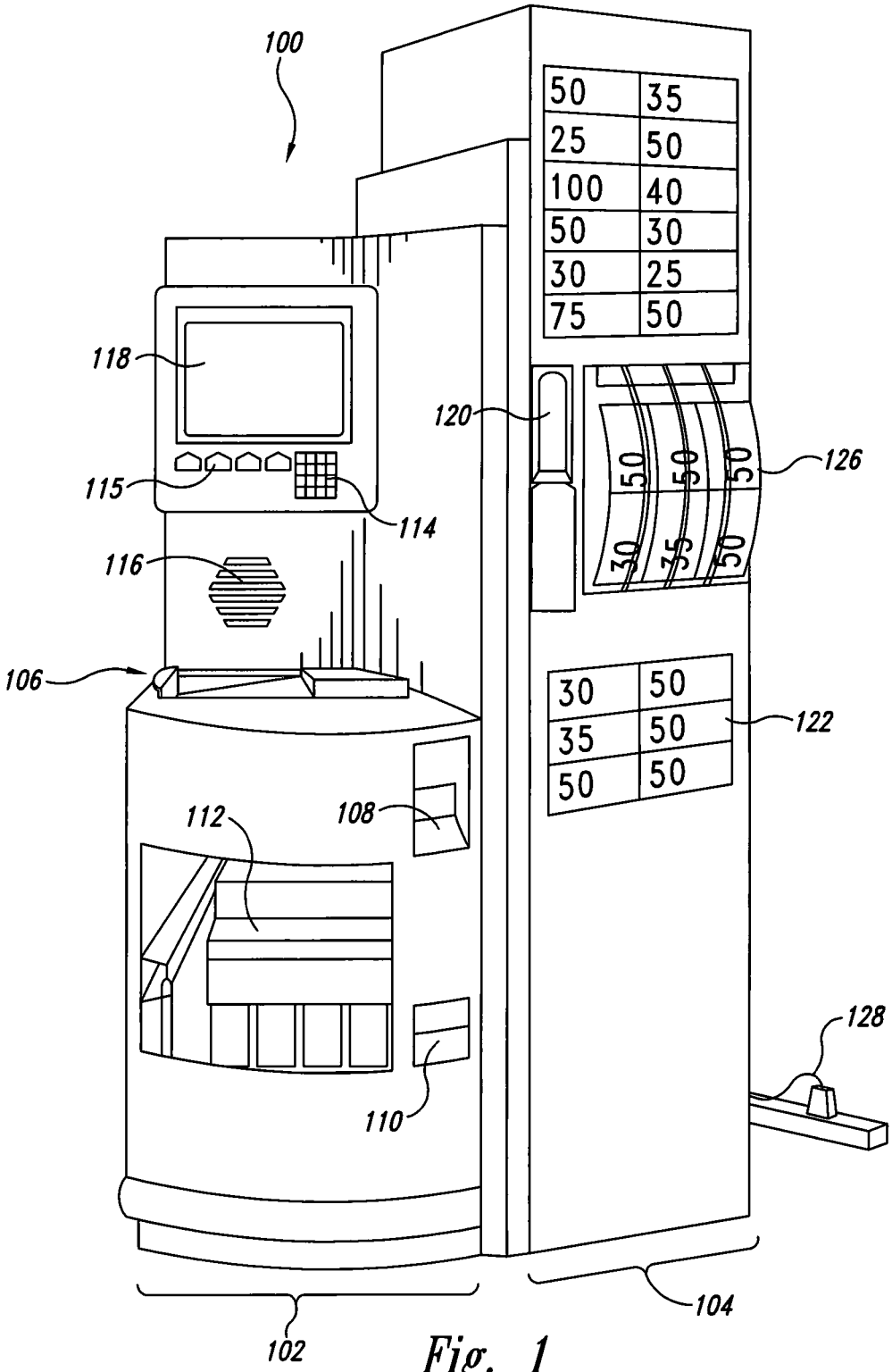
FIG. 1 is a front view of a coin counter/sorter and coupon/voucher dispensing device configured in accordance with an embodiment of the present disclosure.

The following disclosure describes apparatuses, systems, and methods for separating coins from unwanted debris. In particular embodiments, a vane is spaced apart from a portion of a coin track by a predetermined distance. The vane will strike debris larger than the predetermined distance to remove it from the track and will permit coins thinner than the predetermined distance to pass along the track for further handling.

Certain details are set forth in the following description and in FIGS. 1-4C to provide a thorough understanding of various embodiments of the disclosure. Those of ordinary skill in the relevant art will appreciate, however, that the technology disclosed herein can have additional embodiments that may be practiced without several of the details described below and/or with additional features not described below. In addition, some well-known structures and systems often associated with coin sorting apparatuses and methods have not been shown or described in detail below to avoid unnecessarily obscuring the description of the various embodiments of the disclosure. The dimensions, angles, and other specifications shown in the figures are merely illustrative of particular embodiments of the disclosure. Accordingly, other embodiments can have other dimensions, angles, and specifications without departing from the scope of the present disclosure. In the drawings, identical reference numbers identify identical, or at least generally similar, elements. To facilitate the discussion of any particular element, the most significant digit or digits in any reference number refers to the figure in which that element is first introduced. For example, element 210 is first introduced and discussed with reference to FIG. 2.

FIG. 1 illustrates a coin counter/sorter and coupon/voucher dispensing device 100 according to an embodiment of the present disclosure. The device 100 can include a coin counting/sorting portion 102 and a coupon dispensing portion 104. In one embodiment, these portions can operate independently in the sense that it is possible for the coin counting portion 102 to be counting one customer's coins while the dispensing portion 104 is dispensing coupons and/or vouchers to another customer. In the depicted embodiment, the coin counting portion 102 includes an input tray or hopper 106, a voucher dispensing slot 108, a coin return slot 110, a sorting/counting mechanism 112, and customer I/O devices, including a keyboard 114, additional keys 115, a speaker 116 and a video screen 118. The coupon dispensing portion 104 includes an activating device 120 (such as a button), and a coupon receptacle 122. The device 100 can include various indicia, signs, displays, advertisement and the like on its external surfaces.

In the depicted embodiment, portions of the counting/sorting mechanism are visible through a window 126. A power cord 128 provides power to the mechanism as described below.

Figure 2:
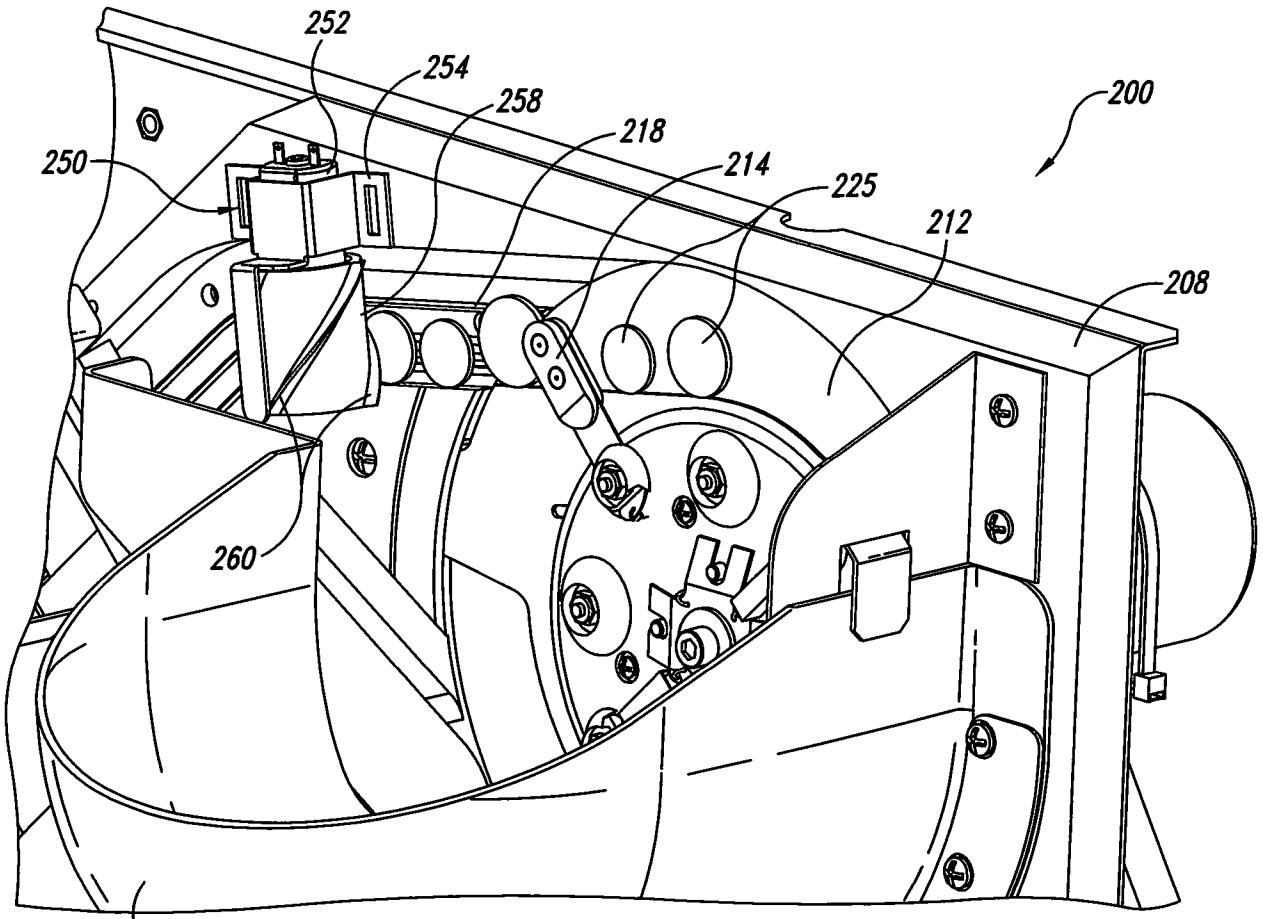
FIG. 2 illustrates a coin sorting assembly including a debris diverter configured according to an embodiment of the present disclosure.

FIG. 2 illustrates a coin sorting assembly 200 according to embodiments of the present disclosure that can be used within a coin sorting and counting device such as the device 100 of FIG. 1. The assembly 200 includes a support 208, a hopper 210 mounted relative to the support 208, and a wheel 212 mounted to the support 208 and positioned at least partially in the hopper 210. The wheel 212 includes a paddle 214, and the wheel 212 and paddle 214 are positioned relative to a sloped track 218. Coins 225 received by the coin sorting device 200 are directed to the hopper 210. The wheel 212 can rotate within the hopper 210 to cause the paddle 214 to engage coins 225 within the hopper 210 and lift the coins onto the track 218. Once the coins 225 are on the track 218, they slide or roll along the track 218 for further processing. Other suitable mechanisms for placing the coins 225 on the track 218 are also compatible with the present disclosure. In addition to the slight downward slope of the track 218, the support 208 can also be inclined backward at a slight angle, such as about 20°, so that the coins 225 will rest against a rear surface 219 of the track 218. The slight angle of the support 208 keeps the coins 225 in place, and keeps them from tipping and falling back down into the hopper 210.

The coin sorting assembly 200 can also include a debris diverter 250. In particular embodiments, the debris diverter 250 includes a motor 252, a mounting bracket 254, a bobbin 258, and a plurality of vanes 260 extending from the bobbin 258. The mounting bracket 254 can hold the debris diverter 250 in position relative to a portion of the track 218. The bobbin 258 and vanes 260 can move relative to the track 218 to permit coins 225 to pass along the track 218 and to prevent other objects from moving along the track 218 in a manner described in more detail below.

Figure 3:
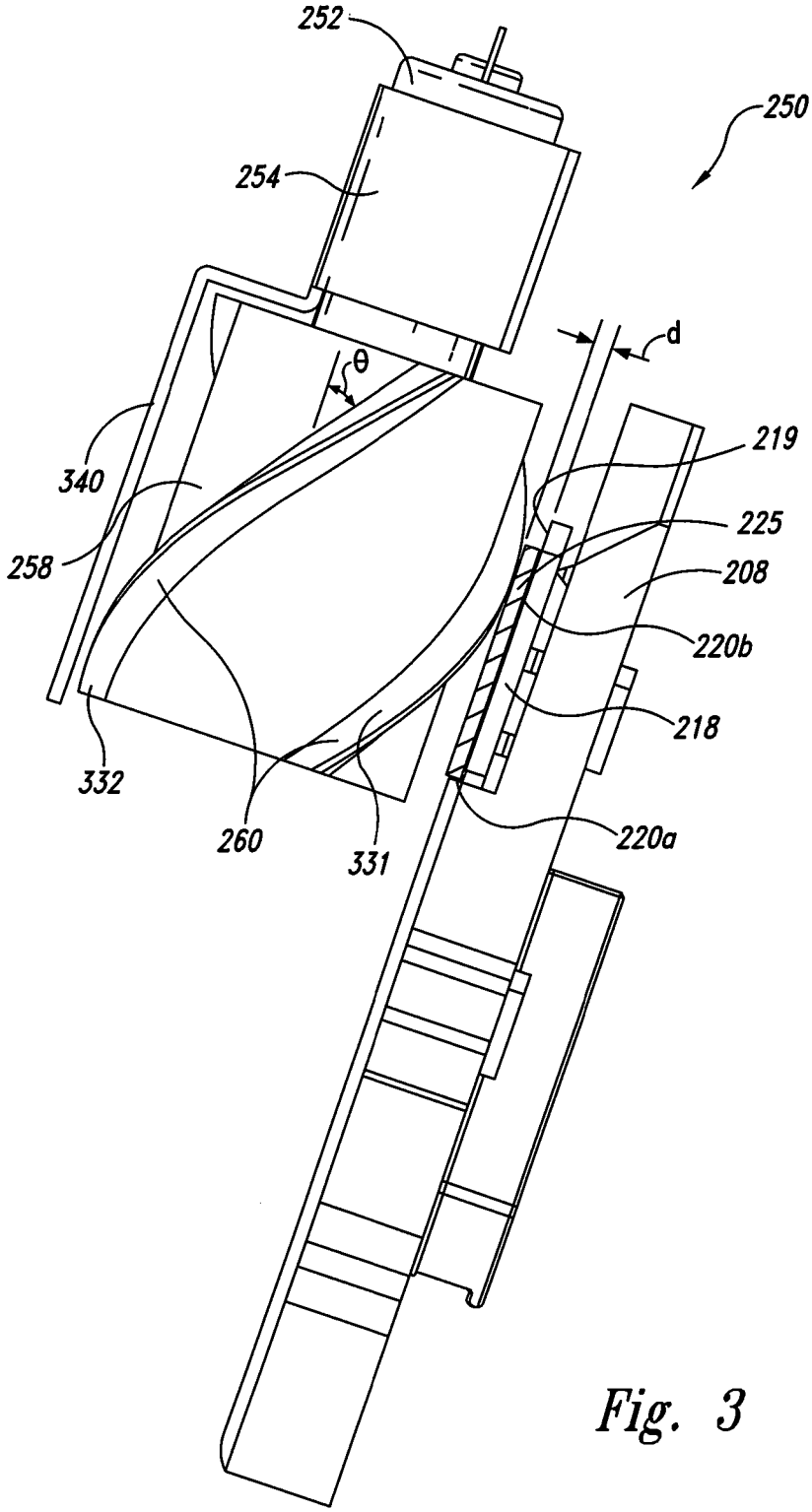
FIG. 3 is an end view of a debris diverter and coin track configured according to embodiments of the present disclosure.

FIG. 3 illustrates an end view of the debris diverter 250 and track 218 of FIG. 2 according to embodiments of the present disclosure. The debris diverter 250 can be positioned relative to the track 218 with the vanes 260 spaced apart from a portion of the track 218 (e.g., the rear surface 219) by a predetermined distance d approximately equal to the thickness of the thickest expected coin 225. The track 218 can have a first surface 220*a* for engaging the edge of the coins 225, and a second surface 220*b* generally orthogonal to the first surface 220*a* for engaging the face of the coins 225. The debris diverter 250 shown is positioned opposite the second surface 220*b* of the track 218, and is configured to pass over the face of the coins 225 to prevent objects thicker than the predetermined distance d from passing. In other embodiments, the debris diverter 250 can be positioned opposite the first surface 220*a* of the track 218 and can prevent coins or other objects having a larger diameter than a predetermined diameter from passing. The predetermined distance d can be slightly larger than a dimension (e.g., thickness or diameter) of the coins 225 so that the coins 225 can pass by the debris diverter 250 unhindered. For example, in the United States the thickest coin in circulation is the fifty-cent piece which is approximately 0.086 inches thick. The predetermined distance d can therefore be slightly larger than 0.086 inches. The vanes 260 will strike debris thicker than the predetermined distance d, therefore removing the debris from the track 218. If the coins 225 are misaligned or stacked, it is possible for coins 225 to be knocked from the track 218. The debris diverter 250 can be positioned over the hopper 210 (see FIG. 2) so all objects deflected from the track 218—both coins 225 and debris—fall back into the hopper 210. Some coins 225 or debris may be placed on the track 218 more than once, but eventually the debris diverter 250 will permit the coins 225 to pass while preventing debris from passing. The coins 225 can then proceed onward toward a counting and/or sorting station or any other desired processing mechanism. The debris left in the hopper 210 can then be flushed from the hopper 210 and disposed of.

The bobbin 258 can be driven by the motor 252. The motor 252 can be any of a variety of suitable types of motors, including a DC electric motor. With the bobbin 258 and the vanes 260 in position relative to the track 218, the motor 252 can be activated when the assembly 200 is in operation and when coins 225 are moving along the track 218 to rotate the vanes 260 relative to the coins 225 and to the track 218. For example, the debris diverter 250 can be part of a coin sorting assembly 200 (FIG. 2), and a controller (not shown) within the coin sorting assembly 200 can operate the debris diverter 250 when the coin sorting assembly 200 is operated. In contrast to a static gate, which may become jammed and prevent the sorting assembly 200 from operating as desired, the movement of the bobbin 258 and vanes 260 relative to the track 218 can cause the vanes 260 to strike debris and remove the debris from the track 218. The debris diverter 250 can also include a finger guard 340 to promote safety and to prevent other objects from striking the bobbin 258 and the vanes 260 and interfering with operation.

In some embodiments, the motor 252 rotates the bobbin 258 at such a rate that at least one vane 260 will strike each coin 225 passing along the track 218 at an assumed maximum coin rate. In other embodiments, the rotational speed of the bobbin 258 is such that two or more vanes 260 pass over each coin 225 moving along the track 218 at an assumed maximum coin rate. In any of these embodiments, the coin rate and the dimensions of the bobbin 258 and of the vanes 260 can factor into the design of the bobbin 258. For example, a larger bobbin 258 diameter will typically require a lower rotational speed. The number of vanes 260 and the pitch and spacing of the vanes 260 can also factor into the determination of rotational speed.

The predetermined distance d between the vanes 260 and the portion of the track 218 is generally defined by a minimum distance between the vanes 260 and the rear surface 219 of the track 218. For example, in embodiments in which the vanes 260 move in a circular path, the distance d can be expressed as a difference between the radius of the circular path and the distance between a central axis of the bobbin 258 and the rear surface 219 of the portion of the track 218. In other embodiments in which the vanes 260 have a different movement pattern, the distance d can be measured differently. The distance d can be adjusted by moving the mounting bracket 254 relative to the track 218. This allows the debris diverter 250 to accept coins 225 having different thicknesses, such as in countries with different currencies, or for sorting other objects (e.g., bottle caps).

The bobbin 258 can rotate with the vanes 260 passing counter to the flow of coins 225 along the track 218 (which is into the page). In other embodiments, the bobbin 258 can rotate in the opposite direction. In some embodiments, the bobbin 258 has a cylindrical shape and the vanes 260 are helical vanes extending along the length of the bobbin 258 and at least partially encircling the bobbin 258. The helical vanes 260 can have a pitch 8 of approximately 30°. The vanes 260 can have an upward-facing surface 331 and an opposing downward-facing surface 332. The bobbin 258 and vanes 260 can move with the upward-facing surface 331 leading and the downward-facing surface 332 trailing. When oriented as shown, the upward-facing surface 331 of the vanes 260 lifts debris upward and out of the track 218.

The illustrated embodiment includes a cylindrical bobbin 258 that moves the vanes 260 in a circular path. In other embodiments, the debris diverter 250 includes other bobbin shapes and motor configurations that move the vanes 260 differently. For example, the bobbin 258 can be shaped to move the vanes 260 in a linear path or an elliptical path. The vanes 260 can move relative to the track 218 so that periodically the vanes 260 pass over the track 218 while spaced from the portion of the track 218 by the predetermined distance d.

Figure 4A:
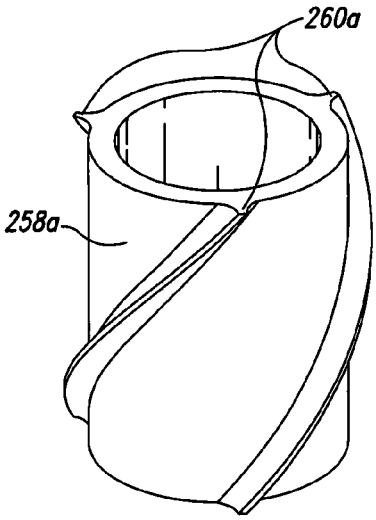
FIGS. 4A-4C are isometric views of bobbins and vanes configured according to embodiments of the present disclosure.
Figure 4B:
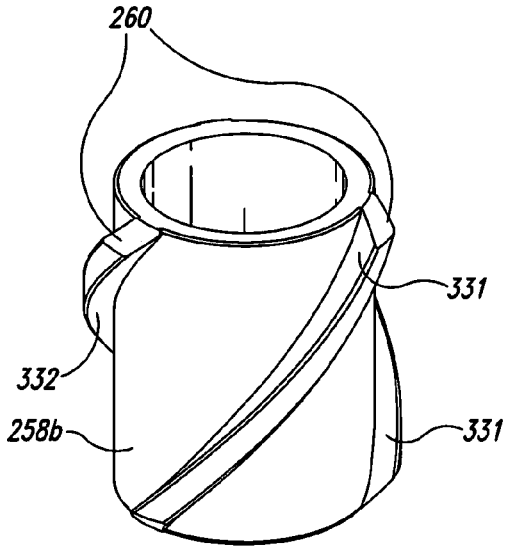
Figure 4C:
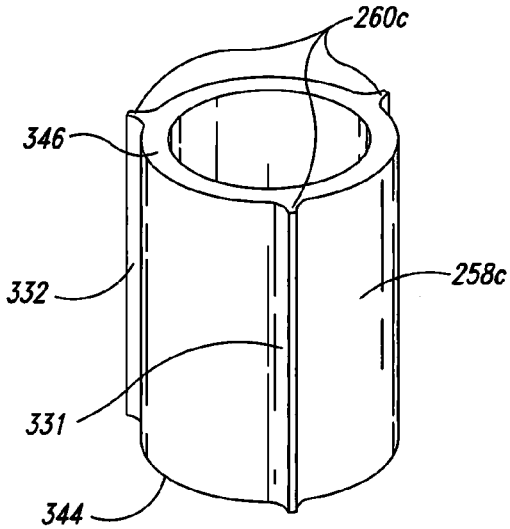

FIGS. 4A-4C illustrate other embodiments of the bobbin 258 and the vanes 260, configured in accordance with embodiments of the present disclosure. FIG. 4A shows a bobbin 258*a* having vanes 260*a* with a triangular cross-section, forming a "squeegee" shape. FIG. 4B illustrates a bobbin 258*b* with vanes 260*b* having a rectangular cross-section. In yet other embodiments, the vanes can have an asymmetric cross-sectional shape in which the leading edge is sloped, similar to the embodiment of FIG. 4A, and the trailing edge is flat, similar to the embodiment of FIG. 4B. FIG. 4C illustrates an embodiment in which the bobbin 258*c* has vanes 260*c* that are generally straight and parallel with a central axis of the bobbin 258. In other words, the bobbin 258*c* and vanes 260*c* have a constant cross-section along their length. The bobbin 258 can be oriented with a distal end 344 tilted slightly toward the upstream direction relative to the track 218 and a proximal end 346 tilted slightly toward the downstream direction. The vanes 260 can therefore still have an upward-facing surface 331 that leads as the bobbin 258 rotates and a downward-facing surface 332 that trails. Other configurations of the vanes 260 are also possible. In still further embodiments, the vanes 260 are not solid, e.g., the vanes 260 include bristles. In yet further embodiments, the vanes 260 can be either flexible or rigid. The bobbin 258 and vanes 260 can be injection-molded using a flexible plastic material to permit a tight fit over a drum that is attached to the motor 252.

In other embodiments, the bobbin 258 has other shapes. For example, in some embodiments the bobbin 258 has a triangular, square, hexagonal, or other polygonal cross-sectional shape. The corners of the polygonal shapes can form vanes and operate to divert debris similar to the vanes 260 discussed above. The polygonal shape of the bobbin 258 can be helical or not. In still further embodiments, more than one bobbin 258 can be used. For example, a second bobbin (not shown) can be positioned with a central axis perpendicular to the first bobbin 258 and can stop debris taller than a predetermined height from passing along the track 218 while allowing coins smaller than the predetermined height to pass. In other embodiments, a second bobbin can have the same orientation as the first bobbin 258 and can accordingly provide redundancy with the first bobbin 258.

The foregoing description of embodiments of the invention is not intended to be exhaustive or to limit the disclosed technology to the precise embodiments disclosed. While specific embodiments of, and examples for, the invention are described herein for illustrative purposes, various equivalent modifications are possible within the scope of the invention, as those of ordinary skill in the relevant art will recognize. For example, although certain functions may be described in the present disclosure in a particular order, in alternate embodiments these functions can be performed in a different order or substantially concurrently, without departing from the spirit or scope of the present disclosure. In addition, the teachings of the present disclosure can be applied to other systems, not only the representative coin sorting systems described herein. Further, various aspects of the invention described herein can be combined to provide yet other embodiments.

All of the references cited herein are incorporated in their entireties by reference. Accordingly, aspects of the invention can be modified, if necessary or desirable, to employ the systems, functions, and concepts of the cited references to provide yet further embodiments of the invention. These and other changes can be made to the invention in light of the above-detailed description. In general, the terms used in the following claims should not be construed to limit the invention to the specific embodiments disclosed in the specification, unless the above-detailed description explicitly defines such terms. Accordingly, the actual scope of the invention encompasses the disclosed embodiments and all equivalent ways of practicing or implementing the invention under the claims.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below," and words of similar import, when used in this application, shall refer to this application as a whole and not to any particular portions of this application. When the claims use the word "or" in reference to a list of two or more items, that word covers all of the following interpretations of the word: any of the items in the list, all of the items in the list, and any combination of the items in the list.

From the foregoing, it will be appreciated that specific embodiments of the disclosed technology have been described herein for purposes of illustration, but that various modifications may be made without deviating from the invention. For example, the vanes can be integral with the bobbin, or can be initially separate and joined to the bobbin. The vanes can be formed of multiple individual projections, rather than single continuous projections. Alternatively, the vanes and bobbin can be any suitable shape that, as the bobbin and vanes rotate, a distance between the outermost extent of the vanes and bobbin varies between a predetermined distance and a larger distance. More particularly, the predetermined distance is approximately equal to a largest acceptable size, such as a largest expected coin for a coin counting and sorting machine. Certain aspects of the invention described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the disclosed technology. Accordingly, the disclosure and associated technology can encompass other embodiments not expressly shown or described herein.

I claim:

1. A debris diverter for a coin sorting machine, the debris diverter comprising:

a coin track positioned to convey coins, the coin track having a first support surface for supporting edges of coins and a second support surface generally orthogonal to the first support surface for supporting faces of the coins, wherein the coin track is configured to support coins as the coins roll on their edges down the coin track; and a moving vane spaced apart from the second support surface of the coin track by a predetermined distance to permit coins thinner than the predetermined distance to move along the coin track past the moving vane, and to at least inhibit debris thicker than the predetermined distance from passing the moving vane along the coin track.

2. The debris diverter of claim 1 wherein the moving vane is mounted to a cylindrical bobbin, and wherein an outer extent of the vane is spaced apart from the coin track by the predetermined distance.

3. The debris diverter of claim 2 wherein the moving vane is a helical vane having a pitch of approximately 30 degrees.

4. The debris diverter of claim 1 wherein the moving vane comprises a rotating vane.

5. The debris diverter of claim 1 wherein the predetermined distance is approximately 0.086 inches.

6. The debris diverter of claim 1, further comprising a rotating bobbin to which the moving vane is mounted, wherein the moving vane extends from the bobbin in a helical manner around at least a portion of the bobbin, the moving vane having an upward-facing surface and a downward-facing surface, and wherein the bobbin rotates in a direction that causes the upward-facing surface of the vanes to contact the debris on the coin track.

7. The debris diverter of claim 1 wherein:

the moving vane is mounted to a cylindrical rotating bobbin having a central axis, and wherein the moving vane extends radially from the cylindrical rotating bobbin and is aligned generally parallel with the central axis;

the track has a flow direction in which objects move along the track;

the cylindrical rotating bobbin rotates with the vane moving against the flow direction; and the cylindrical rotating bobbin is oriented relative to the coin track with a leading edge of the vane facing upward.

8. A debris diverter, comprising:

a hopper positioned to receive coins;

a coin track positioned to convey the coins from the hopper along the coin track, wherein the coin track includes a first support surface for supporting coin edges and a second support surface for supporting coin faces and generally orthogonal to the first support surface, and wherein the first and second support surfaces are configured to support coins as the coins roll on the edges in a single file manner down the coin track; and a rotating bobbin having at least one helical vane extending therefrom, wherein the rotating bobbin is spaced apart from the second support surface of the coin track by a predetermined distance to permit coins thinner than the predetermined distance to pass by the rotating bobbin along the coin track and to at least inhibit objects larger than the predetermined distance from passing the rotating bobbin along the coin track.

9. The debris diverter of claim 8 wherein the vane has a triangular cross-section.

10. The debris diverter of claim 8 wherein the vane has a rectangular cross-section.

11. The debris diverter of claim 8 wherein the vane comprises bristles.

12. The debris diverter of claim 8 wherein the vane is flexible.

13. The debris diverter of claim 8 wherein the debris diverter is part of a coin counting and sorting machine.

14. The debris diverter of claim 13, further comprising a controller configured to operate the debris diverter when the coin counting and sorting machine is active.

15. The debris diverter of claim 8 wherein the rotating bobbin is positioned over the hopper to divert debris from the coin track back into the hopper.

16. A debris diverter for a coin sorting assembly, the debris diverter comprising:

a coin track upon which coins received by the coin sorting assembly are placed, the coin track having a first surface for engaging an edge of the coins and a second surface substantially orthogonal to the first surface for engaging a face of the coins, wherein the coin track is sloped downwardly to permit the coins to move along the coin track in a first direction;

a cylindrical bobbin having a plurality of vanes mounted relative to the coin track and spaced apart from a portion of the second surface of the coin track by a predetermined distance at least generally equal to a largest expected coin thickness; and a motor operably coupled to the bobbin, wherein the motor rotates the bobbin and the vanes in a second direction opposite the first direction, and wherein the bobbin and vanes are configured to rotate and strike objects on the coin track larger than the predetermined distance and remove the objects larger than the predetermined distance from the coin track.

17. The debris diverter of claim 16 wherein the vanes are angled away from the first surface of the coin track.

18. A method for diverting debris from a coin track, the method comprising:

supporting coins with a coin track as the coins roll along coin edges down the coin track, wherein the coin track includes a first support surface for supporting coin edges and a second support surface for supporting coin faces generally orthogonal to the first support surface;

passing objects along the coin track; and moving a vane relative to the coin track with the vane passing over the coin track by a predetermined distance to permit coins thinner than the predetermined distance to pass by the vane along the coin track and to contact objects larger than the predetermined distance on the coin track to divert the objects from the coin track.

19. The method of claim 18 wherein moving the vane comprises rotating a bobbin having a plurality of vanes such that an outer extent of individual vanes passes by the track at the predetermined distance.

20. The method of claim 18 wherein passing objects along the coin track comprises passing objects along the coin track in a first direction, and wherein moving the vane relative to the coin track comprises moving the vane in a second direction opposite the first direction.

21. The method of claim 18 wherein passing objects along the coin track comprises passing objects along the coin track at a predetermined rate, and wherein moving the vane relative to the coin track comprises moving the vane at a sufficient rate that the vane contacts each object moving along the coin track at least once.

22. The debris diverter of claim 1 wherein the coin track is configured to support coins rolling down the coin track one at a time.

23. The debris diverter of claim 1 wherein the second support surface is generally vertical, and wherein the predetermined distance corresponds to a thickest coin to be conveyed down the track such that the vane allows the thickest most coin to pass.

24. The debris diverter of claim 8, further comprising a rotating wheel having a paddle, wherein the paddle is configured to feed coins individually from the hopper onto the coin track.

* * * * *

UNITED STATES PATENT AND TRADEMARK OFFICE

CERTIFICATE OF CORRECTION

PATENT NO. : 8,522,950 B2
APPLICATION NO. : 13/228676
DATED : September 3, 2013
INVENTOR(S) : Douglas A. Martin It is certified that error appears in the above-identified patent and that said Letters Patent is hereby corrected as shown below:

In the Specification

In column 4, line 61, delete "8" and insert -- θ --, therefor.

Signed and Sealed this
Nineteenth Day of November, 2013

Teresa Stanek Rea
*Deputy Director of the United States Patent and Trademark Office*